US007186549B2

(12) United States Patent
Poo et al.

(10) Patent No.: US 7,186,549 B2
(45) Date of Patent: Mar. 6, 2007

(54) CONTAINER FOR SHIPPING ITEMS IN AIRCRAFT

(75) Inventors: Ramon E. Poo, Miami, FL (US); Camillo Ricordi, Miami, FL (US)

(73) Assignees: Biorep Technologies, Inc., Miami, FL (US); University of Miami, Miami, FL (US)

( * ) Notice: Subject to any disclaimer, the term of this patent is extended or adjusted under 35 U.S.C. 154(b) by 0 days.

(21) Appl. No.: 10/829,752

(22) Filed: Apr. 22, 2004

(65) Prior Publication Data

US 2005/0239190 A1 Oct. 27, 2005

(51) Int. Cl.
*C12M 12/00* (2006.01)

(52) U.S. Cl. ..... 435/289.1; 435/298.2; 435/300.1; 435/303.1; 435/809; 220/560.03; 220/1.5; 220/495.01; 220/23.91; 220/501

(58) Field of Classification Search ..... 220/566.11, 220/1.5, 1.6; 206/0.6; 435/286.6, 289.1, 435/300.1, 307.1; 422/113
See application file for complete search history.

(56) References Cited

U.S. PATENT DOCUMENTS 4,246,864 A 1/1981 Pasternack et al.
4,600,114 A * 7/1986 Dabich ..... 220/722
5,960,708 A * 10/1999 DeTemple et al. ..... 99/472
6,019,237 A * 2/2000 Durham et al. ..... 220/1.6
6,264,891 B1 * 7/2001 Heyneker et al. ..... 422/64
6,566,126 B2 * 5/2003 Cadwell ..... 435/297.4
6,593,136 B1 * 7/2003 Geiss ..... 435/325

FOREIGN PATENT DOCUMENTS

| | | |
|---|---|---|
| FR | 2 086 654 A | 12/1971 |
| GB | 1 305 905 A | 2/1973 |
| WO | WO 84/01082 A | 3/1984 |

* cited by examiner

*Primary Examiner*—David Redding
(74) *Attorney, Agent, or Firm*—Akerman Senterfitt

(57) ABSTRACT

A container for shipping items in an aircraft includes a shipping compartment and an expandable chamber for receiving gas from the shipping compartment. At least one conduit connects the expandable chamber to the shipping department so as to permit the flow of gas therebetween. A method for shipping items in an aircraft is also disclosed.

5 Claims, 6 Drawing Sheets

CONTAINER FOR SHIPPING ITEMS IN AIRCRAFT

FIELD OF THE INVENTION

This invention relates generally to shipping containers, and more particularly to containers for shipping items in aircraft.

BACKGROUND OF THE INVENTION

Sealed containers that are shipped or carried in aircraft will experience large forces on the container walls due to a decrease in cabin pressure as the plane increases in altitude. The pressure maintained in the cabin of a commercial aircraft is the atmospheric pressure at 10,000 feet. This pressure is approximately 10 psi. The standard atmospheric pressure at sea level is approximately 14.7 psi. A sealed container measuring 12×12×12 inches will experience a force of 144×(14.7–10) lbf or 676.8 lbf acting on its walls as the plane reaches a cabin altitude of 10,000 feet. A larger container will experience a much larger force. These forces can result in leakage or rupture of the container walls. In the case of shipping containers that are used to ship biological materials, the result will be contamination of the material or mortality in case of living cells and or organs. The gas cannot be vented because of the need to keep incubating gases in contact with the biological materials at an appropriate concentration.

SUMMARY OF THE INVENTION

A container for shipping items in aircraft includes a hermetic shipping compartment and an expandable chamber for receiving gas from the shipping compartment. At least one conduit connects the expandable chamber to the shipping compartment so as to permit the flow of gas therebetween. The expandable chamber can be a bag. The bag can comprise an elastic material. The expandable chamber can also include bellows. The expandable chamber can include a piston. The gas entering the expandable chamber moves the piston.

The container can include a housing. The expandable chamber and the shipping compartment can be provided within the housing. The shipping compartment can include at least one holding tray. The housing can be mounted on a gimbal. The gimbal permits the housing to rotate relative to a support to help to maintain the contents of the shipping container level. The housing can include at least one gas port, and can include at least one gas inlet port and at least one gas outlet port. The housing can include top and bottom portions. The shipping compartment can be in the bottom portion and the expandable chamber can be in the top portion.

A container for shipping biological materials in aircraft includes a hermetic shipping compartment for the biological materials and an expandable chamber for receiving gas from the shipping compartment. At least one conduit connects the expandable chamber to the shipping compartment so as to permit the flow of gas therebetween.

The shipping compartment can comprise an incubating gas. A receptacle for the biological materials is provided and is contained within the shipping compartment. The receptacle comprises a material which is permeable to the incubating gas such that some of the incubating gas in the shipping compartment will contact the biological materials in the receptacle. A preservation solution for the biological materials can be provided in the receptacle and is contained by the receptacle. The receptacle can be a bag formed at least in part by a material which contains the preservation solution and the biological materials, but is permeable to the incubating gas.

The incubating gas can comprise any suitable incubating gas. In one aspect, the incubating gas comprises a mixture of $O_2$ and $CO_2$. The preservation solution can be any suitable preservation solution, or a saline solution or other appropriate solution or liquid. In one aspect the solution includes cell culture media—RL (CMRL 1066) manufactured by Mediatech, Inc. of Herndon, Va.

A method for shipping items on aircraft includes the steps of providing a container having a hermetic shipping compartment and an expandable chamber for receiving gas from the shipping compartment, and at least one conduit connecting the expandable chamber to the shipping compartment so as to permit the flow of gas therebetween. The items are placed into the shipping compartment and the shipping container is placed onto the aircraft. The items can be biological materials. The biological materials can comprise living cells or organs.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE PREFERRED EMBODIMENTS

Figure 1:
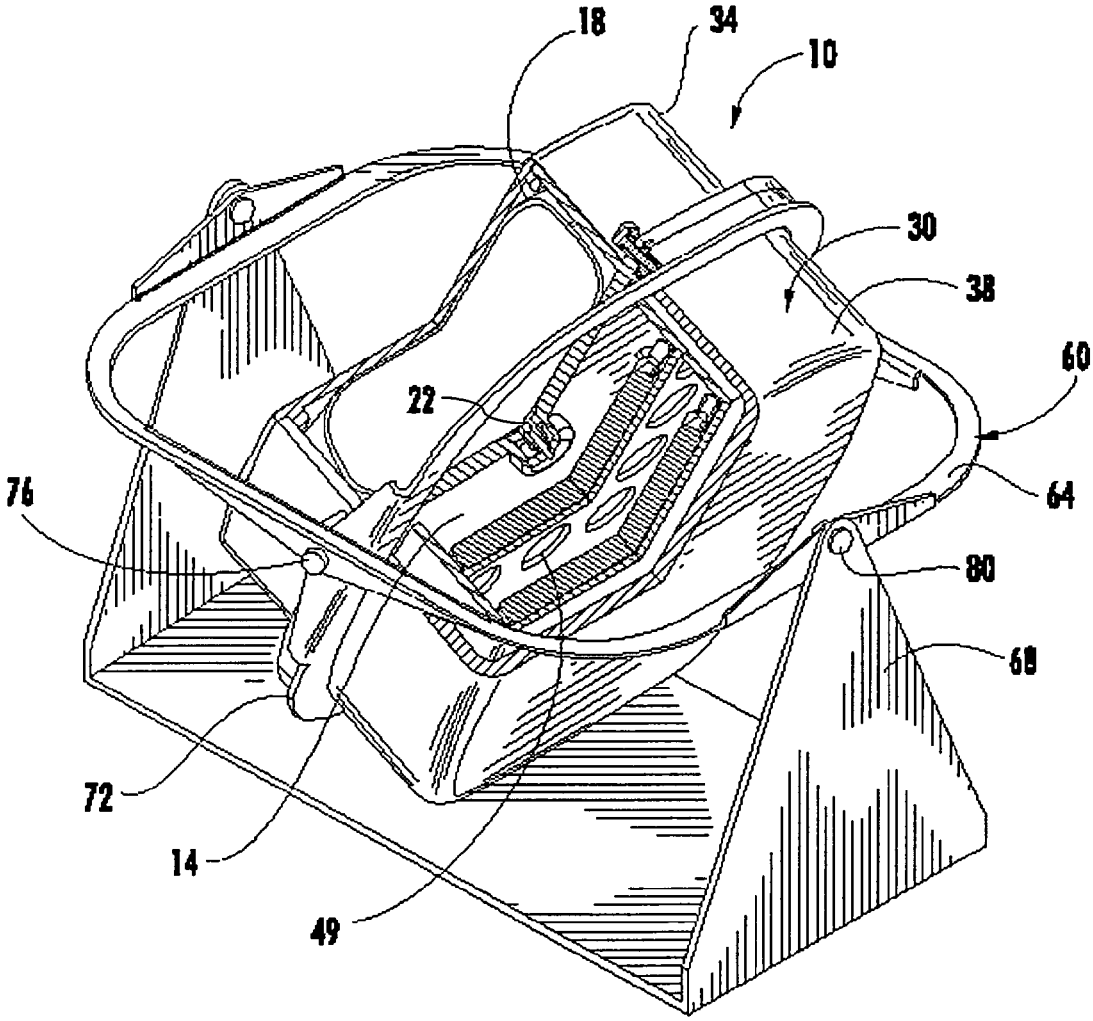
FIG. 1 is a perspective view, partially broken away, of a shipping container according the invention.
Figure 2:
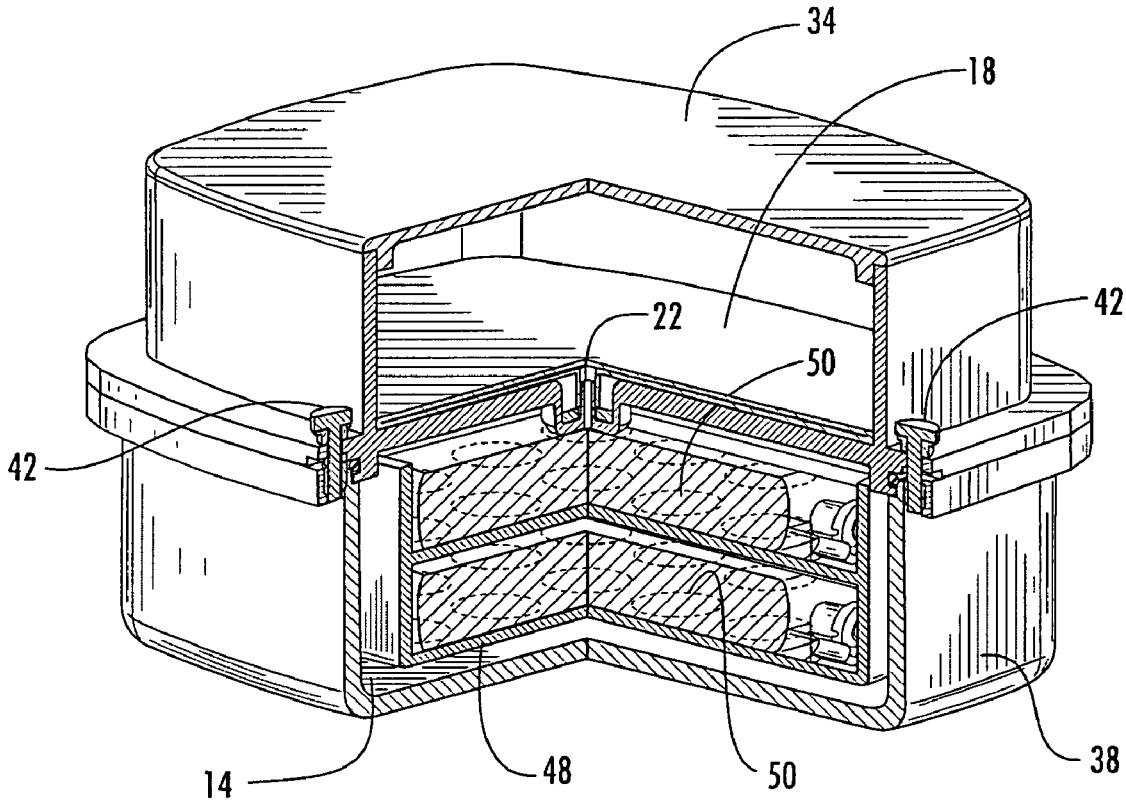
FIG. 2 is a perspective view, partially broken away, of the shipping container in a first mode of operation.

There is shown in FIGS. 1–4 a shipping container according to one aspect of the invention. The shipping container 10 comprises a hermetic shipping compartment 14 and expandable chamber 18 for receiving gas from the shipping compartment 14. At least one conduit 22 is provided for connecting the expandable chamber 18 to the shipping compartment 14 so as to permit the flow of gas therebetween. The conduit 22 can be an opening or plurality of openings, or can be in the nature of one or more channels, tubes, or other suitable structure.

The expandable chamber 18 can be of any suitable construction. In the embodiment shown, the expandable chamber 18 comprises a flexible bag which can receive gas from the shipping compartment 14 when such gas expands under a reduced atmospheric pressure environment. The expandable chamber 18 can be made from an elastic material. The size of the expandable chamber 18 can vary. The volume of an ideal gas, as many gases appear at lower pressures, is inversely proportional to the pressure at constant temperature, according to the formula:

$$P_1 \times V_1 = P_2 \times V_2.$$

Therefore, assuming an ideal gas, the additional volume when the aircraft cabin pressure is at the equivalent of 10,000 feet will be about fifty percent more than the original volume, since the atmospheric pressure will decrease from approximately 14.7 psi to 10 psi. If a container has a volume of one cubic foot, an additional one-half cubic foot will be necessary for expansion in order to maintain the same pressure when in the container. Accordingly, the expandable chamber 18 should be sized according to the size of the shipping compartment 14, the gas within the shipping compartment 14, and the pressure to which the container will be exposed during flight.

The shipping compartment 14 and expandable chamber 18 can be provided within a housing 30. The housing 30 can be of any suitable construction. In the embodiment shown, the housing 30 comprises a top portion 34 and a bottom portion 38. The top portion 34 can contain the expandable chamber 18 and the bottom portion 38 can contain the shipping compartment 14. The expandable chamber 18 can be connected by the conduit 22 to the shipping compartment 14. Other arrangements are possible.

The top portion 34 and the bottom portion 38 can be secured by suitable structure such as locking screws 42. Sealing structure such as an o-ring seal 46 can be provided to complete a hermetic seal between top portion 34 and bottom portion 38. This prevents the incubating gas from escaping in the case where biological materials are being shipped, which would alter the concentration of the incubating gas. This concentration must be maintained to provide optimum shipping conditions for the biological materials. A gas inlet port 35 and gas exit port 37 can be provided to regulate the amount of incubating gas in the shipping container 10. Suitable structure such as caps or valves can be provided to regulate the flow of gas through the ports.

Figure 4:
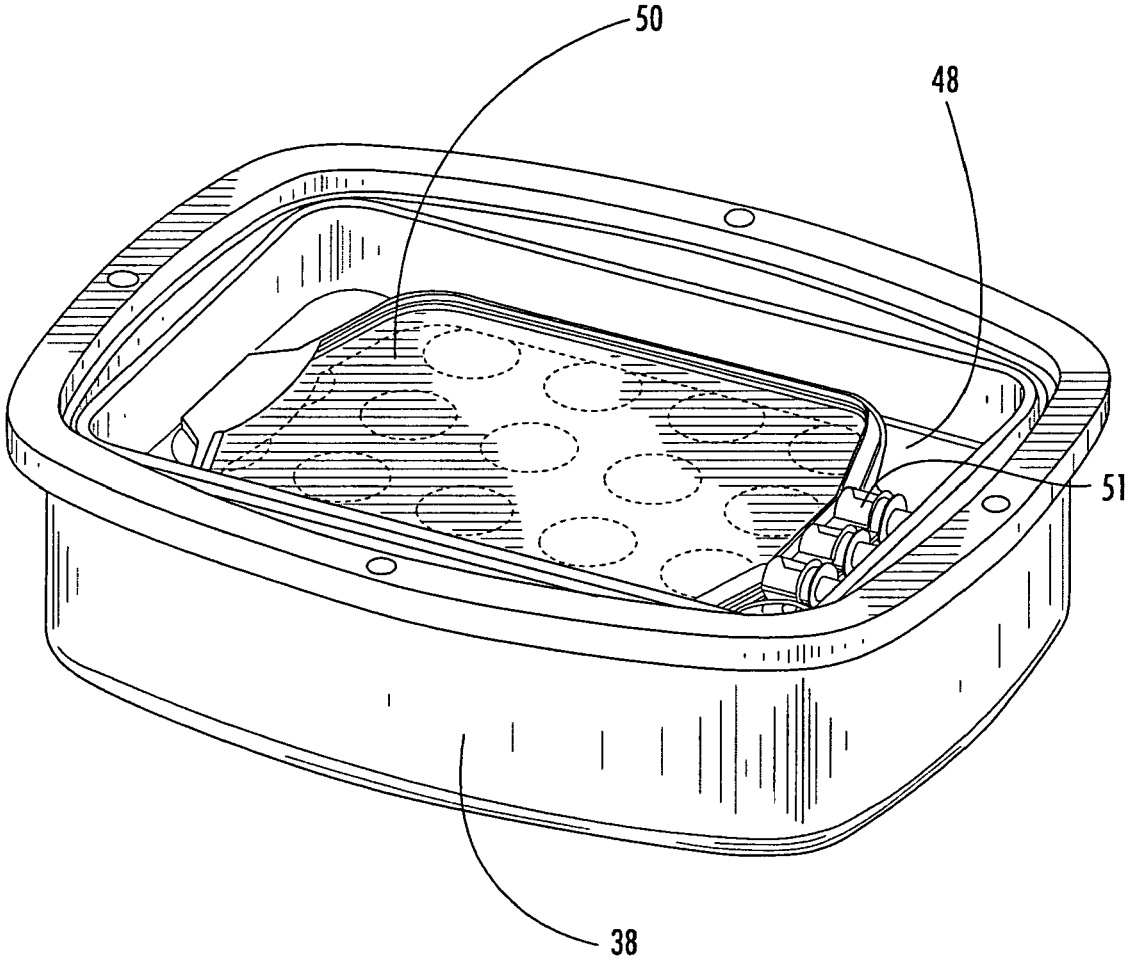
FIG. 4 is a perspective view of a bottom portion of the shipping container according to the invention.

The shipping compartment 14 can have different structure for shipping and retaining different items. In the embodiment shown, the shipping compartment 14 has structure for holding contents such as biological materials. As shown in FIG. 4, bags 50 can be provided for retaining items such as biological materials. The bags 50 retain the biological materials and preservation solution, or other contents in a sterile environment. The bags 50 are permeable to the incubating gas such that this gas can reach and contact the biological material within the bags 50. Structure such as trays 48 can be provided for holding the bags 50 in place. The trays 48 can have apertures 49 to facilitate contact between the incubating gas and the gas-permeable bags 50. Structure such as projections can also be provided to hold the bags 50 from the surface of the shipping compartment so as to facilitate contact between the gas and the bags. Other constructions are possible.

In the embodiment shown, bags 50 can be adapted to contain living cells such as Islet of Langerhans cells used for the treatment of diabetes. The transportation of islet cells requires a preservation solution and an incubating gas. Any suitable preservation solution can be used. The preservation solution and biological materials will be sealed within the bags 50, as by a closure 51.

Figure 3:
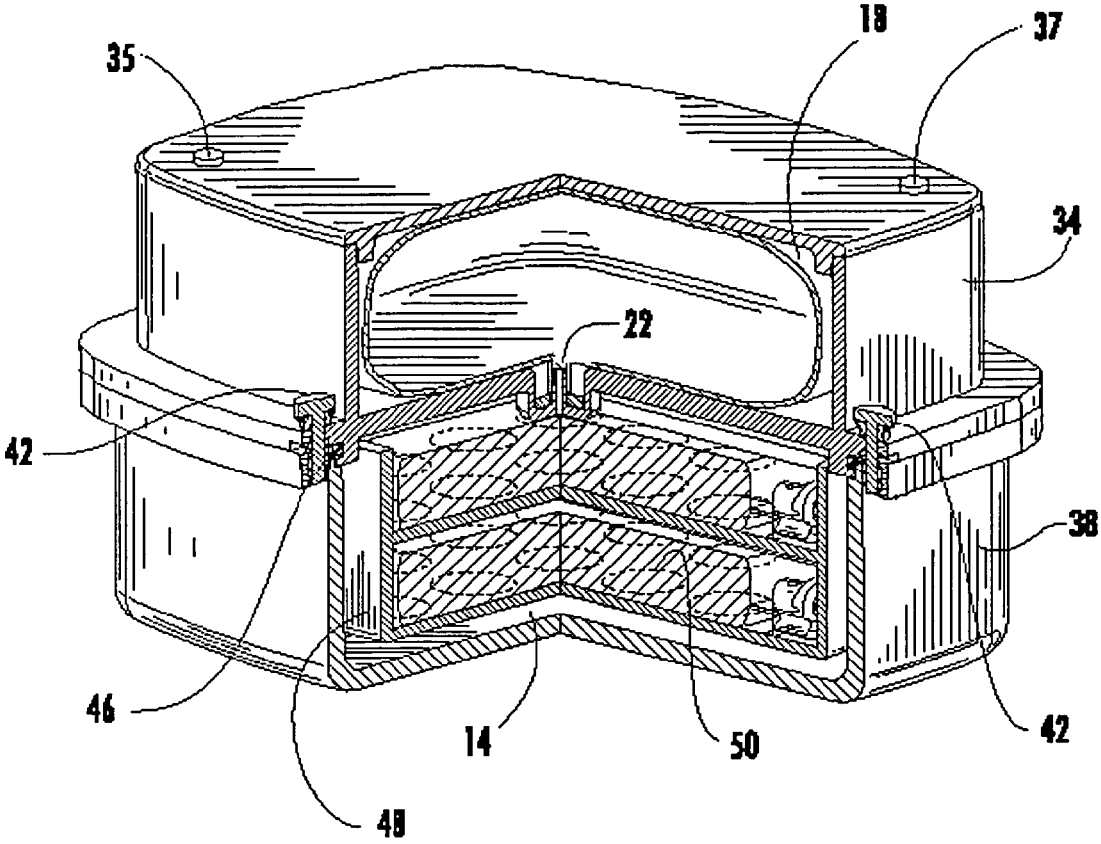
FIG. 3 is a perspective view, partially broken away, in a second mode of operation.

Any suitable incubating gas can be used. A suitable incubating gas is a mixture of $O_2$ and $CO_2$. This gas will expand in the shipping compartment 14 during travel in an airplane at altitude. In this case, gas from the shipping compartment 14 will pass through the conduit 22 into the expandable chamber 18. The expandable chamber 18 will then expand as shown in FIG. 3, thus preventing leakage of the incubating gas from the container 10.

Figure 5:
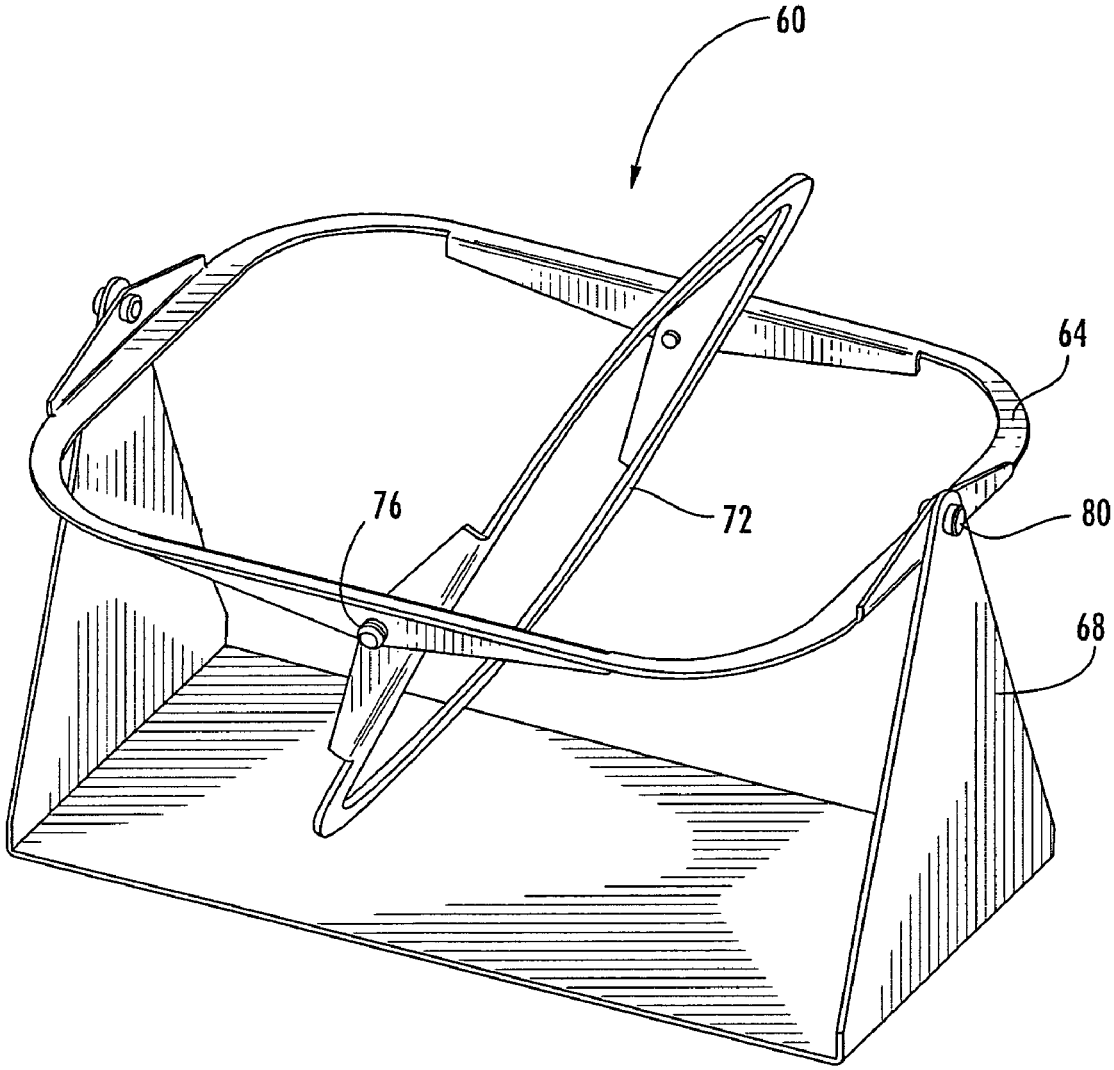
FIG. 5 is a perspective view of a gimbal assembly according to the invention.

It is desirable that the shipping compartment 14 remain level when transporting living cells and organs. There is shown in FIG. 5 a gimbal structure 60 comprising an outer ring 64 that is pivotally mounted to a support 68. An inner ring 72 is pivotally mounted to the outer ring 64 about structure such as pivot pins 76. The outer ring 64 can be pivotally mounted to the support 68 by suitable structure such as pivot pins 80. As shown in FIG. 1, the housing 30 can be mounted to the inner ring 72 such that the housing will remain substantially level as the aircraft changes its position. Other structure for maintaining the level of the shipping compartment 14 is possible.

The shipping container 10 according to the invention can be manufactured from suitable materials such as metals and plastics. In the case of shipping biological materials, medical grade materials which are sterile are required.

Figure 6:
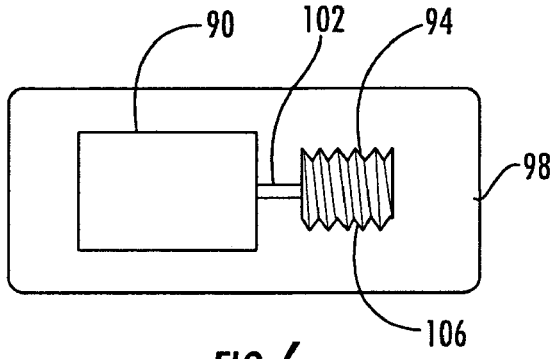
FIG. 6 is a schematic diagram of another embodiment.

There is shown in FIG. 6 an alternative embodiment in which a shipping compartment 90 and expandable chamber 94 are provided within a housing 98. A conduit 102 connects the shipping compartment 90 to the expandable chamber 94. The expandable chamber 94 can be provided by a flexible material including bellows 106 which permit the expandable chamber 94 to expand when gas is received from the shipping compartment 90. The bellows 106 provide some biasing towards a compressed, original condition such that a gas which expands into the expandable chamber 94 is squeezed back into the shipping compartment 90 as the aircraft returns from altitude.

Figure 7:
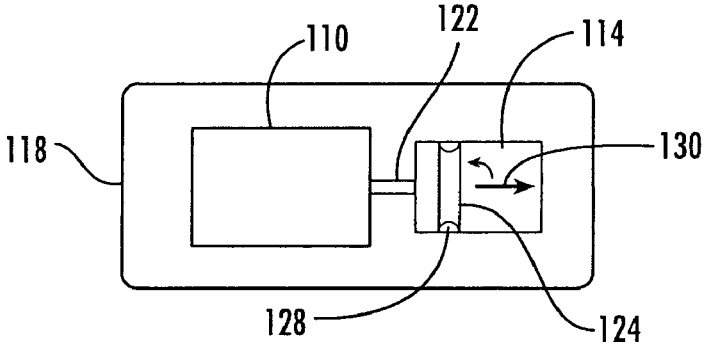
FIG. 7 is a schematic diagram of yet another embodiment.

There is shown in FIG. 7 an alternative embodiment in which a shipping compartment 110 and expandable chamber 114 are provided within a housing 118. A conduit 122 can connect the shipping compartment 110 to the expandable chamber 114. In this embodiment, the expandable chamber 114 has rigid side walls and has within a movable piston 124. Gas entering the expandable chamber 114 contacts the piston 124 and moves it in the direction of arrow 130 so as to provide an increased volume to receive gas from the shipping compartment 110. Suitable seals such as o-ring 128 can be provided to seal the piston 124 against the walls of the expandable chamber 114. Biasing such as a spring can be provided to return the piston 124 to an original position as the aircraft descends to atmospheric pressure.

Figure 8A:
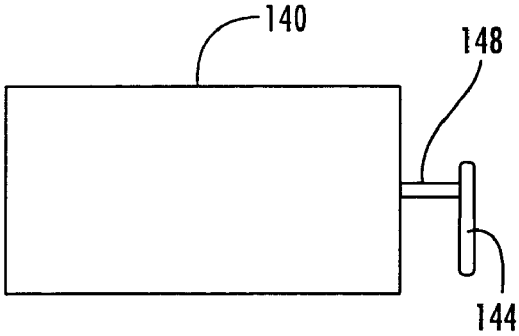
FIGS. 8*a*–8*b* are schematic diagrams of another embodiment in alternative modes of operation.
Figure 8B:
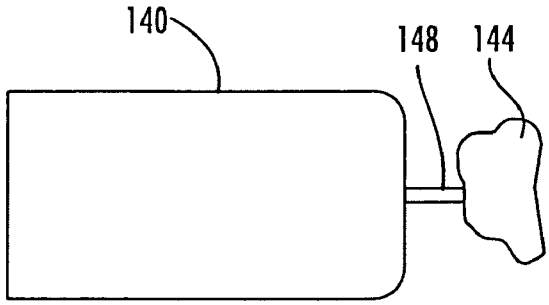

There is shown in FIG. 8 an alternative embodiment in which a shipping compartment 140 is provided and connected to an expandable chamber 144 by a suitable conduit 148. The expandable chamber 144 can be a bag having flexible sides. As the aircraft ascends and the volume of gas in the shipping compartment 140 expands, the gas will be conveyed by conduit 148 into the bag 144 to expand the bag from the position shown in FIG. 8*a* to the position shown in FIG. 8*b*.

This invention can be embodied in other forms without departing from the spirit or essential attributes thereof and accordingly, reference should be made to the following claims, rather to the foregoing specification, to determine the scope of the invention.

We claim:

1. A container for shipping items in aircraft, comprising:

a hermetic shipping compartment; and an expandable, hermetic chamber for receiving gas from said shipping compartment;

wherein said container comprises a rigid protective housing, said expandable chamber and said shipping compartment both being within said rigid housing, and at least one conduit connecting said expandable chamber to said shipping compartment so as to permit the flow of gas therebetween.

2. A container for shipping items in aircraft, comprising:

a hermetic shipping compartment;

an expandable chamber for receiving gas from said shipping compartment;

wherein said container comprises a housing, said expandable chamber and said shipping compartment being within said housing, and at least one conduit connecting said expandable chamber to said shipping compartment so as to permit the flow of gas therebetween; and, wherein said housing comprises top and bottom portions, said shipping compartment being in said bottom portion and said expandable chamber being in said top portion.

3. A container for shipping items in aircraft, comprising:

a hermetic shipping compartment;

an expandable chamber for receiving gas from said shipping compartment;

at least one conduit connecting said expandable chamber to said shipping compartment so as to permit the flow of gas therebetween; and a housing, said expandable chamber and said shipping compartment being within said housing; and wherein said housing is mounted on a gimbal.

4. A container for shipping biological materials in aircraft, comprising:

a hermetic shipping compartment for said biological materials, said compartment containing an incubating gas and a receptacle for containing said biological materials, said receptacle being permeable to said incubating gas;

an expandable, hermetic chamber for receiving gas from said shipping compartment; and, at least one conduit connecting said expandable chamber to said shipping compartment so as to permit the flow of gas therebetween;

said shipping compartment and said expandable chamber both being provided within a rigid protective housing.

5. The container of claim 4, wherein said gas comprises a mixture of $O_2$ and $CO_2$.

* * * * *